US010603669B2

(12) United States Patent
Rath et al.

(10) Patent No.: US 10,603,669 B2
(45) Date of Patent: Mar. 31, 2020

(54) AGITATOR BALL MILL

(71) Applicant: NETZSCH-Feinmahltechnik GmbH, Selb (DE)

(72) Inventors: Philipp Rath, Selb (DE); Lars-Peter Weiland, Schönwald (DE)

(73) Assignee: NETZSCH-Feinmahltechnik GmbH, Selb (DE)

( * ) Notice: Subject to any disclaimer, the term of this patent is extended or adjusted under 35 U.S.C. 154(b) by 997 days.

(21) Appl. No.: 15/052,358

(22) Filed: Feb. 24, 2016

(65) Prior Publication Data

US 2016/0318027 A1 Nov. 3, 2016

(30) Foreign Application Priority Data

Apr. 16, 2015 (DE) ..... 10 2015 105 804

(51) Int. Cl.

*B02C 17/18* (2006.01)
*B02C 17/00* (2006.01)
*B02C 17/16* (2006.01)

(52) U.S. Cl.

CPC ..... *B02C 17/1865* (2013.01); *B02C 17/00* (2013.01); *B02C 17/16* (2013.01); *B02C 17/1815* (2013.01)

(58) Field of Classification Search

CPC ..... B02C 17/1815; B02C 17/16; F25B 9/14
USPC ..... 241/66, 23, 65, 67; 62/51.1, 6
See application file for complete search history.

(56) References Cited

U.S. PATENT DOCUMENTS 328,686 A * 10/1885 Johnson ..... F25B 41/062 62/222
513,421 A * 1/1894 Rowland ..... H01F 27/18 174/15.1
1,658,187 A * 2/1928 Dyer ..... F25D 31/002 62/205
1,810,750 A * 6/1931 Braunstein ..... A61C 1/0007 62/93
3,202,364 A * 8/1965 Wieland ..... B02C 17/00 241/172
3,688,514 A * 9/1972 Prost ..... F17C 3/085 62/51.1
3,700,029 A * 10/1972 Thrun ..... F01N 3/043 165/51
3,703,925 A * 11/1972 Ireland ..... F28F 1/28 165/151
3,779,306 A * 12/1973 Wilson ..... F22D 1/32 165/297
3,828,850 A * 8/1974 McMinn ..... B01J 4/001 165/109.1

(Continued)

FOREIGN PATENT DOCUMENTS

DE 202005000280 U1 3/2005
DE 60224331 T2 1/2009
JP H09239253 A 9/1997

*Primary Examiner* — Sean M Michalski
(74) *Attorney, Agent, or Firm* — Whitmyer IP Group LLC

(57) ABSTRACT

An agitator ball mill with a fluid circuit, which includes a grinding container and a casing container disposed around the latter uniformly spaced apart axially with a cavity formed between the containers. The fluid circuit is led at at least one flange through at least one flange lead-through introduced there, wherein a first opening of the at least one flange lead-through is constituted in a side wall of the corresponding flange lying orthogonal to the outer surface of the casing container.

18 Claims, 4 Drawing Sheets

(56) References Cited

U.S. PATENT DOCUMENTS 3,848,429 A * 11/1974 Franklin, Jr. ..... F25D 3/00 62/439
3,909,225 A * 9/1975 Rooney ..... F25B 19/00 62/51.1
3,934,857 A * 1/1976 Hege ..... B01F 15/068 366/144
3,983,191 A * 9/1976 Schauls ..... F25J 5/002 261/114.1
4,068,495 A * 1/1978 Alger ..... G21K 5/08 313/22
4,089,370 A * 5/1978 Marchal ..... F28D 7/103 165/159
4,125,385 A * 11/1978 Rado ..... B01D 45/12 165/140
4,162,191 A * 7/1979 Cella ..... F28F 9/0136 122/34
4,174,074 A * 11/1979 Geiger ..... B02C 17/16 241/172
4,198,828 A * 4/1980 Mercier ..... F16L 59/184 62/50.1
4,291,760 A * 9/1981 Argvle ..... F02M 26/32 123/568.12
4,302,950 A * 12/1981 Sitte ..... G01N 1/42 62/51.1
4,345,549 A * 8/1982 Colmano ..... F22B 1/025 122/34
4,399,484 A * 8/1983 Mayer ..... H05K 7/20345 165/908
4,488,681 A * 12/1984 Lindsey ..... F24B 7/005 126/99 D
4,531,372 A * 7/1985 Slabaugh ..... F04B 37/08 137/601.07
4,644,761 A * 2/1987 Chatzipetros .... G01N 23/20016 378/81
4,694,663 A * 9/1987 Miller ..... F17C 3/085 220/560.12
4,715,186 A * 12/1987 Ishimaru ..... F17C 13/085 220/506
4,796,432 A * 1/1989 Fixsen ..... F17C 3/08 62/51.1
4,841,732 A * 6/1989 Sarcia ..... F17C 6/00 62/49.1
4,919,347 A * 4/1990 Kamiwano ..... B02C 17/166 241/174
4,942,742 A * 7/1990 Burruel ..... F25O 1/04 249/119
5,148,863 A * 9/1992 Fouts ..... F28D 1/0333 165/144
5,187,938 A * 2/1993 Mraz ..... F04D 19/02 415/182.1
5,235,818 A * 8/1993 Horikawa ..... F25D 19/006 505/892
5,257,742 A * 11/1993 Yashima ..... B02C 17/1815 241/172
5,261,244 A * 11/1993 Lessard ..... B01D 8/00 417/901
5,265,318 A * 11/1993 Shero ..... B23P 11/025 15/321
5,346,145 A * 9/1994 Kamiwano ..... B02C 17/166 241/172
5,379,952 A * 1/1995 Geiger ..... B02C 17/16 241/172
5,404,726 A * 4/1995 Janssen ..... F16L 35/00 62/295
5,464,163 A * 11/1995 Zoz ..... B02C 17/16 241/172
5,853,132 A * 12/1998 Tsuji ..... B02C 17/16 241/172
5,950,943 A * 9/1999 Stehr ..... B02C 17/166 241/171
6,425,540 B1 * 7/2002 Morris ..... B02C 7/00 241/278.1
6,431,478 B1 * 8/2002 Reed ..... B02C 17/166 241/172
6,588,690 B1 * 7/2003 Koenig ..... A61L 11/00 241/260.1
8,794,558 B2 * 8/2014 Pausch ..... B02C 17/16 241/171
8,960,082 B2 * 2/2015 Bjoerk ..... A47J 43/0727 241/282.1
9,494,344 B2 * 11/2016 Kraus ..... G01R 33/3815
2007/0084951 A1 * 4/2007 Ueno ..... B02C 2/10 241/65
2008/0241374 A1 * 10/2008 Gillman ..... B01J 2/006 427/216
2009/0179099 A1 * 7/2009 Stehr ..... B02C 17/16 241/171
2009/0194616 A1 * 8/2009 Hiew ..... B02C 7/17 241/23
2009/0242673 A1 * 10/2009 Ishikawa ..... B02C 17/161 241/65
2010/0127106 A1 * 5/2010 Fornasier ..... B01F 7/00208 241/66
2010/0270408 A1 * 10/2010 Ishikawa ..... B02C 17/163 241/171
2011/0168814 A1 * 7/2011 Brook-Levinson ..... B02C 17/161 241/21
2018/0207645 A1 * 7/2018 Chen ..... B02C 13/2804
2018/0297035 A1 * 10/2018 Simons ..... B02C 17/1815
2018/0318842 A1 * 11/2018 Korzenski ..... B02C 17/1815

* cited by examiner

Prior Art

AGITATOR BALL MILL

TECHNICAL FIELD

The present invention relates to an agitator ball mill with a fluid circuit, wherein the agitator ball mill comprises two containers disposed one inside the other radially spaced apart approximately uniformly, which containers form a cavity between them and which are fixed in each case at their axial ends to a flange, wherein at least one of the flanges comprises a flange lead-through.

BACKGROUND

Many processes, chemical, mechanical or other, take place with the generation of process heat, which can have an unfavourable effect on the process cycle itself or the initial materials used, because for example the materials involved in the process are temperature-sensitive or the change in temperature influences the rate of the process and makes an orderly process control difficult. For this reason, it is common to stabilise a process cycle by, for example, conducting away the generated process heat by means of suitable cooling devices or processes.

In the reverse case, it is also possible that heat has to be fed to processes in order to get to the process under way or to operate it in a controlled manner at a preferred temperature.

Processes taking place in containers are usually temperature-regulated via the container wall, for example by cooling or hot water pipes running at the wall, or by the fact that a further outer container disposed radially spaced apart from the first container is placed around the first container, so that a cavity is formed between the two containers, through which cavity a fluid flow, which may be a hot water flow or a coolant flow, can be conveyed for the transport of the process heat.

Designs of the latter-mentioned type are well known from the prior art, for example from JPH09239253A, the subject-matter whereof is an agitator ball mill, wherein a coolant flow is enabled in the cavity between the container walls, in that the entry of the coolant into the cavity takes place through a coolant inlet disposed in the container wall of the agitator ball mill and the heated cooling water can drain away again through a coolant outlet also disposed in the container wall.

In DE 20 2005 000 280U1, this concept it is pursued further in that not only the cavity in the outer container, but also a correspondingly constituted inner container is supplied in such a manner with a coolant flow.

A cooling device, wherein cold air is used as a cooling medium, is described in DE 602 24 331 T2.

A common feature with all these devices is that the location of the corresponding supply connections, i.e. the inlet and outlet openings for the coolant flow, is disposed in the container wall; this has the advantage of shorter paths, is easy to implement and at the same time reduces the number of any transfer connections that need to be created.

A drawback with such a concept, however, is that the accesses to the coolant supply or the associated connections in and/or on the respective device are disposed spread apart and are therefore bound to have a relatively high space requirement for connection spaces, maintenance areas and so forth. This usually results in a system arrangement in which individual systems must have a much greater spacing from one another than would be required for a normal operation.

The problem underlying the present invention, therefore, is to design an agitator ball mill of the aforementioned type in such a way that a more compact structure emerges, on which the connection lines are easily accessible and the maintenance outlay is at the same time reduced The aforementioned problem is solved by an agitator ball mill with a fluid circuit and at least one flange lead-through according to the features of the present invention.

SUMMARY

The agitator ball mill according to the invention comprises two containers having a preferably cylindrical or conical shape, said containers being disposed radially spaced apart one inside the other. The inner grinding container, in which the grinding process takes place, is disposed coaxial with the outer casing container and approximately uniformly spaced apart from the latter radially. Furthermore, the casing container not only has a larger diameter, but usually also at least the same length, so that the grinding container lying inside can be fully accommodated by the casing container. As a result of this embodiment, there is formed between the two containers a cavity suitable for accommodating a fluid flow, said cavity having a spacing between the respective container walls that is dependent on the diameters of the containers. The two containers are fixed at their respective axial end to a flange, which permits the fitting of further components belonging to the equipment of an agitator ball mill and which adequately seals the cavity existing between the containers.

This may be a machine housing at the one axial end of the preferably cylindrical or conical container, which machine housing can contain for example the bearing of the agitator shaft required for the operation of the agitator ball mill, the drive arrangement for said agitator shaft, any control devices and so forth. The housing-side flange, i.e. the flange which is disposed facing the machine housing, is preferably fixed to a correspondingly constituted mounting flange, which can be regarded as a component part of the machine housing. Such a connection usually takes place in such a way that the faces of the housing-side flange and the mounting flange, facing one another and preferably constituted flat, come to lie against one another and are connected detachably to one another by means of suitably constituted screw connections. Any openings, lead-throughs and so forth, which are formed on the housing-side flange and the mounting flange in a corresponding manner, are thereby sealed by means of suitable sealing means, for example suitably shaped O-rings, with respect to the connecting area present between the flange and mounting flange, in such a way that the connecting area itself is protected against incoming fluid.

The grinding container bottom is located at the, in the axial direction, opposite end of the container and therefore the end located remote from the machine housing, i.e. on the flange present there which can be referred to as the bottom flange; a separating device, an outlet opening for the grinding stock ground in the agitator ball mill and/or similar devices are usually present in said grinding container bottom.

In the agitator ball mill according to the invention, in contrast with agitator ball mills known from the prior art, the connection openings, i.e. the inlet and outlet openings for the fluid supply, can be located at the housing-side flange side facing the machine housing and are then accessible at this point. Since the housing-side flange side can be fixed to the mounting flange, the connection openings required for the fluid supply are also constituted in a corresponding manner in the mounting flange.

In order not to increase the overall cross-section of the system beyond the existing size and at the same time to ensure a reliable seating of the connection openings for an external fluid supply line, which feeds the fluid of the agitator ball mill from an external source, and for such a fluid discharge line, which discharges the fluid exiting from the agitator ball mill and, where applicable, feeds it to a disposal device, it is possible with the agitator ball mill according to the invention to provide the connection openings on the side wall of the housing-side flange facing the machine housing and located orthogonal to the casing outer surface, i.e. the outer surface of the casing container, or on the side wall of the mounting flange constituted corresponding thereto.

In order to be able to connect the fluid supply and/or discharge line to the connection openings, i.e. the inlet and/or outlet openings, the connection openings in the mounting flange connected in a corresponding manner to the housing-side flange are provided with means for the detachable connection to the respective fluid supply and/or discharge line, as a rule connection elements such as simple hose connectors, but in particular quick-action connecting elements such as hose couplings or suchlike.

The flange lead-through required to create a supply line to the fluid comprises, as will be explained in greater detail below, a through-hole in the simplest case. Since the housing-side flange, as already described, is usually fixed to the mounting flange, there is introduced into the latter a bore corresponding to the flange bore, at the housing side whereof, leading away from the containers, the connection element for the fluid supply line conveying the fluid is fixed. This connection element can be welded, soldered or fixed in some other way to the lead-through of the mounting flange; it is also conceivable that the lead-through of the mounting flange is provided with a thread, so that the connection element can be suitably screwed in. The flange or mounting-flange lead-through required for the fluid discharge can be constituted identically.

The arrangement of the connection openings at the side wall of a flange means that in at least one flange, depending on the embodiment, there is at least one suitable flange lead-through, through which a fluid for example can be conveyed. Such a flange lead-through is essentially a channel with a first opening, through which a fluid can enter into the channel, and a second opening, through which the fluid can leave the channel again. It goes without saying that the terms first and second opening are only of an explanatory nature and are not to be understood in absolute terms, since their definition can for example depend on the flow direction of the fluid flow.

A flange lead-through, which can be regarded as a component part of the fluid circuit, can be constituted in various forms. The simplest form is a simple flange channel, which leads through the flange in a straight manner, parallel to the axis of the grinding container. The first opening can for example be disposed, as indicated above, at the side wall of the housing-side flange facing the machine housing and located orthogonal to the casing outer surface, the second opening at the opposite side wall facing away from the machine housing. The flange channel is constituted such that the point whereof that lies closest to the axis, related to the axis of the grinding container, has a spacing from the axis of the grinding container which is at least as great as the spacing of the casing outer surface from this axis, i.e. the openings of the flange channel lie radially spaced apart outside the casing outer surface.

A further form of the flange lead-through is represented by a cavity channel, wherein the first opening is disposed at a side wall of the flange, the second opening, on the other hand, at a transition region from the flange to the cavity located between the grinding container and casing container.

Such a cavity channel, in its simplest form, is almost identical to the flange channel described above, but in this case its openings lie at the level of the cavity and the radial diameter of at least the second opening pointing towards the cavity must not exceed the internal spacing between the grinding chamber and the casing container. The diameter of the first opening facing away from the cavity can also be smaller or larger than the diameter of the second opening, so that the cavity channel can for example assume the form of a truncated cone, but is preferably identical to the diameter of the second opening.

It should be regarded as self-evident that the shape of such a flange lead-through does not necessarily have to be round, but can also have other shapes, for which the aforementioned size relationships similarly apply.

In a further embodiment of a cavity channel, the first opening can be disposed at a side wall of the flange and, viewed radially, closer to the axis than the cavity; however, such an opening preferably lies outside the radius of the casing container. The second opening, on the other hand, lies in turn in the transition region from the flange to the cavity, wherein in this case the size of the second opening depends on the embodiment of the connection of the flange, grinding container and casing container: if, for example, the lateral face of the housing-side flange facing away from the machine housing is constituted straight and without graduations etc. at the level of the grinding container and casing container, the second opening must be located at this side wall, so that what has been stated above for the flange channel applies to the connection to the cavity, i.e. the radial diameter of the second opening should not be greater than the radial spacing of the grinding container and the casing container.

There can however also be an embodiment, wherein for example the grinding container is constituted somewhat longer than the casing container, so that the flange is at least partially milled out inside the inner radius of the casing container or, in a further embodiment, a ring corresponding to the shape of the cavity can be milled into the flange. In both the aforementioned cases, the cavity would be lengthened into the flange, so that the second opening of the cavity channel does not have to be disposed in the axial direction, but can be introduced at the level of the cavity for example from a radial direction into the cavity.

These arrangements of the respective openings mentioned by way of example give rise to a course of the respectively corresponding cavity channel that does not necessarily have to run rectilinearly, but can also be constituted in an angular and/or curved manner. This can take place for example by a suitable bore or also by milling out a corresponding channel and closing at least a partial region of the milled channel with a matching closure lid or suchlike.

The variability of the possibilities of embodiment of a cavity channel also makes it possible to dispose both the first and the second opening on one side of the flange. This can be expedient for example when the fluid flow, as will be explained in greater detail below, enters into the flange at an opening located outside the radius of the casing container, is then directed in a radial direction towards the cavity and can finally transfer at the level of the cavity into the latter.

Usually, the fluid flow is introduced, for temperature regulation purposes, at an opening into the cavity and flows along the grinding container to be temperature-regulated to a further opening, so that the fluid can be completely washed around the grinding container in the cavity between the containers; the heat thereby absorbed is thus carried away from the cavity via the latter-mentioned opening, which lies distant from the first-mentioned opening, usually diagonally opposite. In the reverse case, it is of course also possible that heat can be fed to a grinding process in the aforementioned manner, whereby heated fluid is introduced into the fluid circuit.

If the outlet opening is located for example on the housing-side flange, the fluid should flow into the cavity ideally at the bottom flange, i.e. the flange facing away from the machine housing. Alternatively, it is possible to have the outlet opening at the bottom flange and the fluid inlet on the housing-side flange, i.e. with an opposite flow direction in the cavity. Since the connection openings for the external fluid supply and discharge lines are however disposed in an inventive way at the housing-side flange, the need arises to guide the fluid flow entering at the housing-side flange, in this case preferably via a flange channel, to the bottom flange, where it can be introduced into the cavity via a suitable flange lead-through.

The aforementioned fluid guidance can take place by means of a flange line, which takes up the fluid at the housing-side flange and conveys it onward to the flange lead-through at the point on the bottom flange provided for this purpose, so that the openings of the flange lead-throughs constituted as a cavity channel and/or a flange channel in the housing-side flange and the bottom flange are connected to one another by a fluid-conveying flange line, said openings being disposed in the respective side wall and in each case facing one another. In the simplest case, a correspondingly suitable flange line can be a closed pipeline with a suitable cross-section, but otherwise an arbitrary cross-section in terms of shape and diameter, which pipeline is located at the second opening of the flange channel of the housing-side flange, said opening facing away from the machine housing, and which leads along the casing container to the first opening of a cavity channel, said opening facing the machine housing, which cavity channel in turn creates a connection to the cavity via a second opening present at the other end of the cavity channel. A pipeline constituted in this way can be disposed distant from the casing container or also adjacent to the latter, if need be also connected to the latter, for example by welding or soldering.

As an alternative to the pipeline, the guidance of the fluid can also take place along the casing container in the form of a casing line. With this form of the flange line, a part of the casing container or of the casing outer surface at the same time forms a part of the casing line, so that a fluid conveyed through a casing line flows directly along the part of the casing container belonging to the casing line; at this point, the casing container and the casing line have a common wall.

A casing line can be constituted for example by the fact that a pipe with a non-closed, for example semicircular cross-section is placed with the open side on the casing container and is then connected on both sides to the casing container by a weld or solder joint or a similarly stable form of connection.

Such a casing line requires additional outlay in production, but has the advantage of higher mechanical stability, because, in the case of the aforementioned semicircular design for example, it is fixed in the axial direction to the casing container at both sides of the line; with a standard pipeline with, for example, a circular cross-section, such a fixing is not possible. Diverging from the semicircular design, other, in particular angular line shapes are also possible, depending on the intended application. In addition to conveying a fluid flow, such a casing line can thus also assume mechanical functions and, for example during maintenance work when the grinding cylinder comprising the grinding container and casing container is removed from the machine housing, serve as a holding element, which rests on a suitable holding device for bearing the grinding cylinder and is capable of carrying its weight.

In addition, it should be noted at this point that the embodiment of a flange line as a pipeline does not require any special attention in terms of the position of the flange lead-through on the respective flange, since a pipeline that is not constituted straight does not represent a technical challenge, i.e. it can also be constituted angular and/or curved. In the case of a casing line, on the other hand, it is advantageous for production-related reasons, though not imperative, if the flange lead-throughs of the housing-side flange and the bottom flange connected by the respective casing line are constituted aligned with one another.

It should also be noted that the fluid in the cavity between the grinding container and the casing container does not have to be conveyed solely via flange lead-throughs; it is of course possible that, for example, the fluid supply at the bottom flange can also take place via an opening in the casing container at which a line is disposed, which starts at a flange channel on the housing-side flange. It is important that at least one of the flanges, preferably the housing-side one, comprises at least one flange lead-through, with which the desired aim of the invention can be achieved.

Furthermore, it is conceivable that the fluid flow is also conveyed through the grinding container bottom. For this purpose, the bottom flange must be constituted with one or more flange lead-throughs, the grinding container bottom in turn with corresponding openings corresponding to the flange lead-throughs and channels, milled recesses or suchlike suitable for conveying the fluid. In this way, heat can for example be carried away from the grinding container bottom or can be fed to the latter.

An example of a fluid circuit that uses the elements already described could take the following form: the fluid to the used is introduced into a flange channel via a fluid supply line, which is arranged at an inlet opening on the housing-side flange or on the correspondingly constituted mounting flange, and passes via an associated flange line to a cavity channel on the bottom flange, through which the fluid can enter into the cavity between the grinding container and the casing container and is conveyed in the latter along the container walls to a further cavity channel, this time in the housing-side flange. The fluid exiting from the housing-side flange then passes, as applicable, through the mounting flange and can then exit through a corresponding outlet opening into a fluid discharge line connected to the latter.

For the sake of clarification, it should be mentioned here that, as already pointed out above, the definition of inlet opening and outlet opening is not to be understood in absolute terms, but rather depends on the flow direction of the fluid; the designation can accordingly change if the flow direction of the fluid is reversed, which of course is readily possible if the need arises for such a step. In the simplest case, the fluid supply line and discharge line have to be exchanged with one another for this purpose.

Furthermore, it should be pointed out that the previously described embodiments of the connection openings are embodiments which are constituted directly on the respective flange or mounting flange. As a rule, a supporting element is located on the corresponding flange, said supporting element supporting, for example at the machine housing-side end, the agitator shaft, etc. or, on the side lying opposite the machine housing, the separating device. Such a supporting element can have the same diameter, if need be also a smaller diameter or a larger diameter than the flange located at the respective side and be connected to the latter over the entire area, so that the corresponding connection openings would be covered by the supporting element. It is self-evident that, in such a case, the corresponding flange lead-throughs for the inlet opening and outlet opening can be constituted lengthened by the respective supporting element or can be constituted in a corresponding form, as a result of which the supporting element itself can form a mounting flange or assume the function of such a mounting flange; the connecting elements would then be constituted analogous thereto and on the respective supporting element according to the description mentioned above.

It should also not be overlooked that a fluid suitable for the fluid circuit in the agitator ball mill according to the invention can be a liquid or a gas, which can be used for example as a coolant, a heating medium, a cleaning agent or as a flushing agent for flushing out another fluid from a fluid line. Thus, for example, it is possible to drain a first fluid used as a coolant, for example cooling water, through the fluid discharge line before maintenance work and then to fit another fluid supply line, for example a compressed air hose, at the inlet opening, and to remove the first fluid still present in the lines etc. with the aid of a second fluid, for example compressed air, by means of a blow-out procedure. It is to be regarded as self-evident that the lines involved in this process are suitably constituted.

It is advantageous if the fluid supply and discharge lines and the inlet and outlet openings are joined together by means for a detachable connection, in particular by quick-action connectors such as hose couplings etc.

It can be particularly advantageous if the fluid supply and/or discharge lines are connected permanently, for example by suitable weld joints, or in a detachable manner as screw joints, to the inlet and outlet openings on the mounting flange. For this purpose, the lines can be connected to the fluid supply and/or discharge line by a system comprising suitably constituted multi-way valves and/or T-pieces and/or suitable solenoid or automatic valves. The multi-way valves can be operated manually, the solenoid and automatic valves semi-automatically or fully automatically by means of a suitable pneumatic, hydraulic and/or electrical control constituted according to the type of valve. The control itself can be constituted so as to be independent or can also be integrated into the process control of the agitator ball mill according to the invention.

On the basis of the description, it can clearly be seen that the embodiment of the agitator ball mill according to the invention is much more maintenance-friendly than the variants known from the prior art, since the inlet and outlet openings on the housing-side flange or the mounting flange are accessible from the machine housing; the agitator ball mill according to the invention is much more compact. Since, in addition, a side access for the connection of the fluid supply and/or discharge lines no longer has to take place, the room previously required for this purpose can also be used for other purposes, for example the spacing from an adjacent system or suchlike can prove to be smaller. A further advantage of the embodiment according to the invention can be the fact that the use of hoses or lines susceptible to contamination can thus for the most part or even completely be dispensed with.

The present invention also relates to a method for conveying a fluid in an agitator ball mill, which can be constituted in a manner described above, wherein at least one of the flanges is equipped with a flange lead-through and the fluid flow is conveyed through the at least one flange lead-through.

The method according to the invention can also be used in another form, such that a first fluid present in the fluid circuit can be displaced from the fluid circuit by supplying a further fluid different from the first fluid.

It is thus possible, for example, to remove residues of a cooling liquid used to cool the grinding container, which for example has to be drained from the fluid circuit of the agitator ball mill during maintenance work, with the aid of a further fluid such as compressed air, nitrogen or suchlike, in that the fluid supply line conveying the cooling liquid is removed from the corresponding inlet opening and replaced by a fluid supply line conveying compressed air for example, so that the compressed air then entering into the fluid circuit can displace the cooling liquid present there or its remaining residue from the fluid circuit. Depending on the embodiment of the fluid discharge line, it may be necessary, if appropriate, also to previously adapt the fluid discharge line in an expedient way.

BRIEF DESCRIPTION OF THE DRAWINGS

Examples of embodiment of the invention and its advantages are explained below in greater detail with the aid of the appended figures. The size ratios of the individual elements with respect to one another in the figures do not always correspond to the actual size ratios, since some forms are represented simplified and other forms are represented enlarged in relation to other elements for the sake of better illustration.

Identical reference numbers are used for identical or identically acting elements of the invention. Furthermore, for the sake of a clearer view, only reference numbers are represented in the individual figures that are required for the description of the respective figure. The represented embodiments only represent examples as to how the device according to the invention can be constituted and do not represent a conclusive limitation.

DETAILED DESCRIPTION

Figure 1:
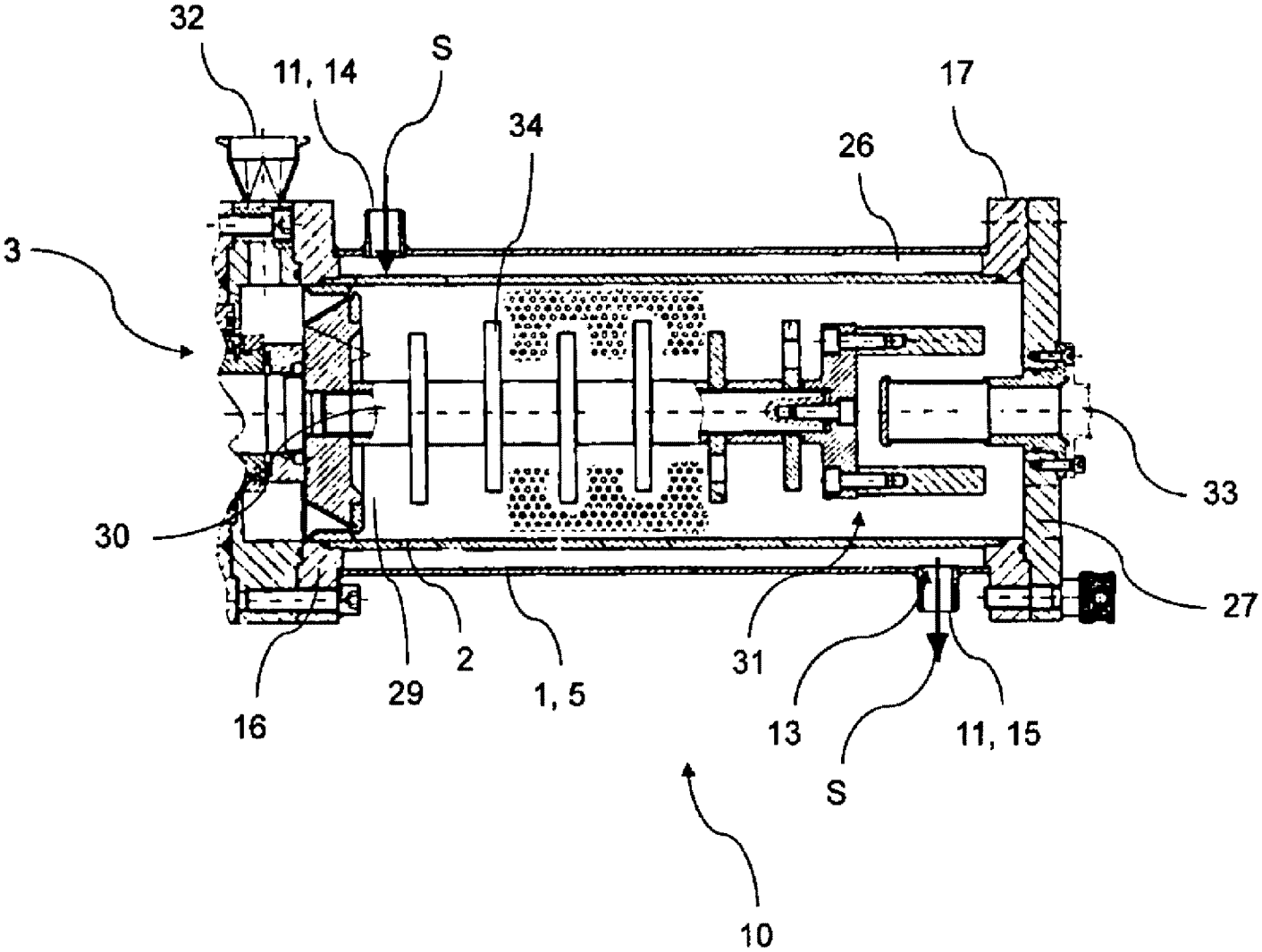
FIG. 1 shows a diagrammatic view of a longitudinal section of an agitator ball mill known from the prior art.

FIG. 1 shows a diagrammatic view of a longitudinal section of an agitator ball mill known from the prior art. Agitator ball mill 10 comprises a grinding container 2, in which an agitator shaft 30 is disposed centrally. Grinding discs 34 are disposed on agitator shaft 30, said grinding discs providing the motion of the grinding stock in grinding container 2. The grinding stock is supplied via grinding stock inlet 32 of agitator ball mill 10, i.e. to grinding chamber 29, and is conveyed in the direction of grinding stock outlet 33 by the grinding bodies set into motion by agitator shaft 30 and its grinding discs 34. A separating device 31 is disposed in front of grinding stock outlet 33, said separating device separating the grinding bodies from the finish-ground grinding stock.

Grinding container 2 is surrounded by a casing container 1, wherein the two containers 1, 2 are spaced apart from one another in the radial direction. As a result of this spacing, a cavity 26 is formed between grinding container 2 and casing container 1, which cavity can serve to accommodate a fluid, usually a cooling fluid. Said cavity is closed off by flanges 16 and 17 provided at both sides of containers 1, 2 in the axial direction and fixed to the latter, wherein housing-side flange 16 is disposed on machine housing 3, whilst bottom flange 17 is located on the side lying opposite containers 1, 2, at which side grinding stock outlet 33 is located. A supporting element 27 is fixed to bottom flange 17, said supporting element supporting grinding stock outlet 33 and closing off grinding chamber 29 to the exterior.

An inlet opening 14 introduced into the wall of casing container 1 is used for supplying the fluid into cavity 26, through which inlet opening the fluid can enter into cavity 26 in the flow direction or flow direction S. Outlet opening 15 lies diagonally opposite inlet opening 14 and is also disposed in the wall of casing container 1, through which outlet opening the fluid can leave cavity 26 again in flow direction S. Both inlet opening 14 and outlet opening 15 are provided with connection elements 11, to which lines for the fluid supply or discharge can be fitted.

Figure 2:
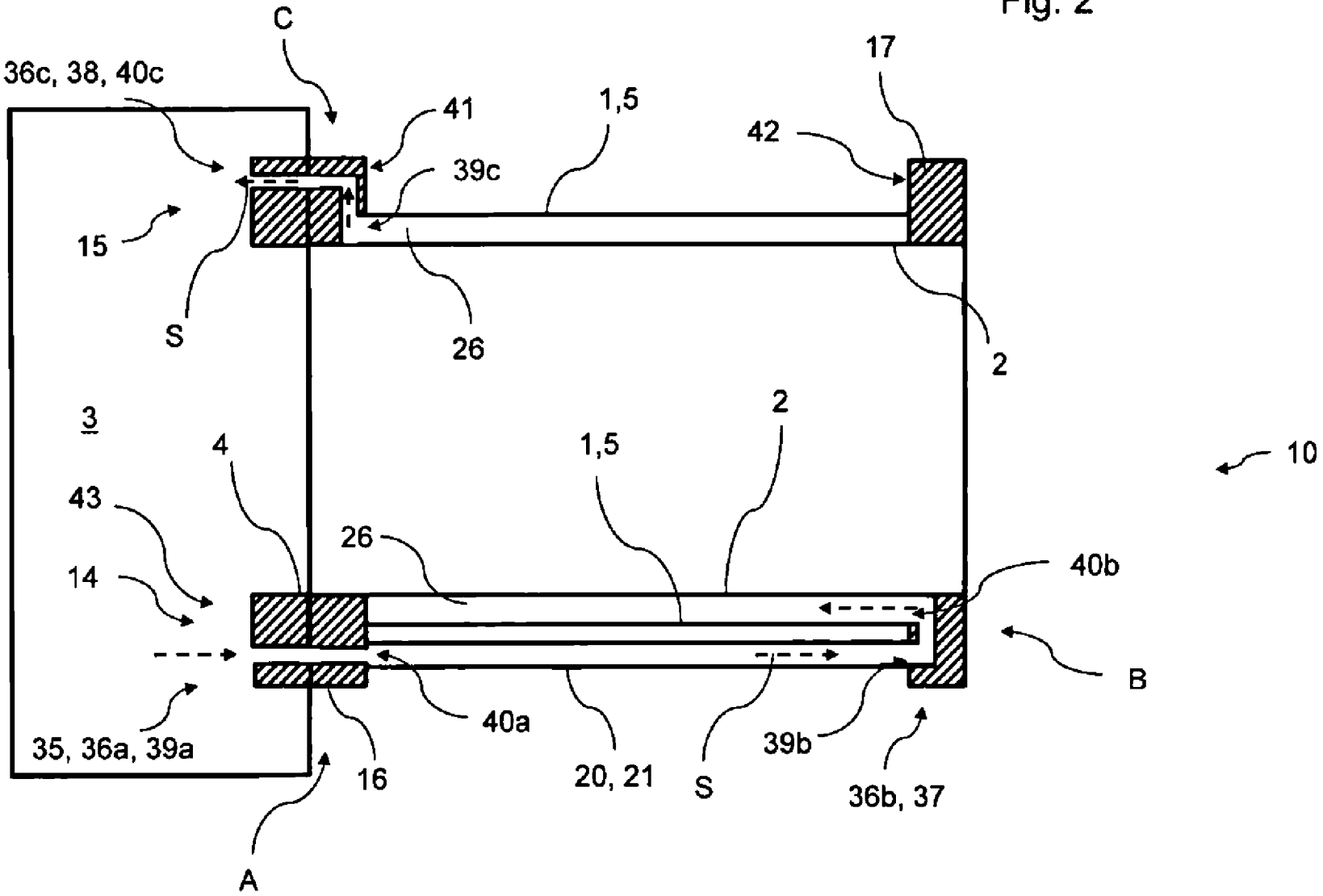
FIG. 2 shows a very simplified diagrammatic view of a longitudinal section of a first embodiment of an agitator ball mill according to the invention.

FIG. 2 shows a diagrammatic longitudinal section through an embodiment of an agitator ball mill according to the invention with a fluid circuit.

Casing container 1 and grinding container 2 are connected to a housing-side flange 16 and a bottom flange 17, wherein housing-side flange 16 is fixed to a machine housing 3, more precisely to a mounting flange 4 provided there. The embodiment of an agitator ball mill shown in FIG. 2 shows, with the aid of three variants A, B, C of a flange lead-through 36*a*, 36*b*, 36*c*, how a fluid, which is flowing in flow direction S, is conveyed from inlet opening 14 in mounting flange 4 to an outlet opening 15 also present in mounting flange 4.

In variant A, the fluid enters through first opening 39*a* of flange channel 35 into housing-side flange 16 and is conveyed onward through second opening 40*a* of flange channel 35, which is introduced in side wall 41 of housing-side flange 16 facing grinding stock outlet 33 into flange line 20. Flange line 20, which is constituted here as pipeline 21 constituted spaced apart from casing container 1, conveys the fluid from housing-side flange 16 to bottom flange 17, wherein the fluid enters into bottom flange 17 via first opening 39*b* of flange lead-through 36*b* constituted as a cavity channel 37.

Cavity channel 37 in bottom flange 17 according to variant B is constituted such that both first opening 39*b*, through which the fluid enters into bottom flange 17, and second opening 40*b*, through which the fluid exits again from cavity channel 37 of bottom flange 17, are disposed on the same side wall 42 of bottom flange 17 facing machine housing 3, wherein second opening 40*b* lies at the level of cavity 26 and the fluid can transfer through said second opening into cavity 26.

Subsequently, the fluid in cavity 26 between casing container 1 and grinding container 2 flows onward in the direction of flange lead-through 36*c*, characterised as variant C of flange lead-through 36 and constituted as second cavity channel 38, to housing-side flange 16, enters there through first opening 39*c* of second cavity channel 38, which is introduced into side wall 41 of housing-side flange 16 facing away from machine housing 3, into said second cavity channel and finally exits again out of the agitator ball mill through second opening 40*c* of second cavity channel 38, which is introduced into side wall 43 of front flange 16 facing machine housing 3, and an opening in mounting flange 4 corresponding to second cavity channel 38.

Figure 3:
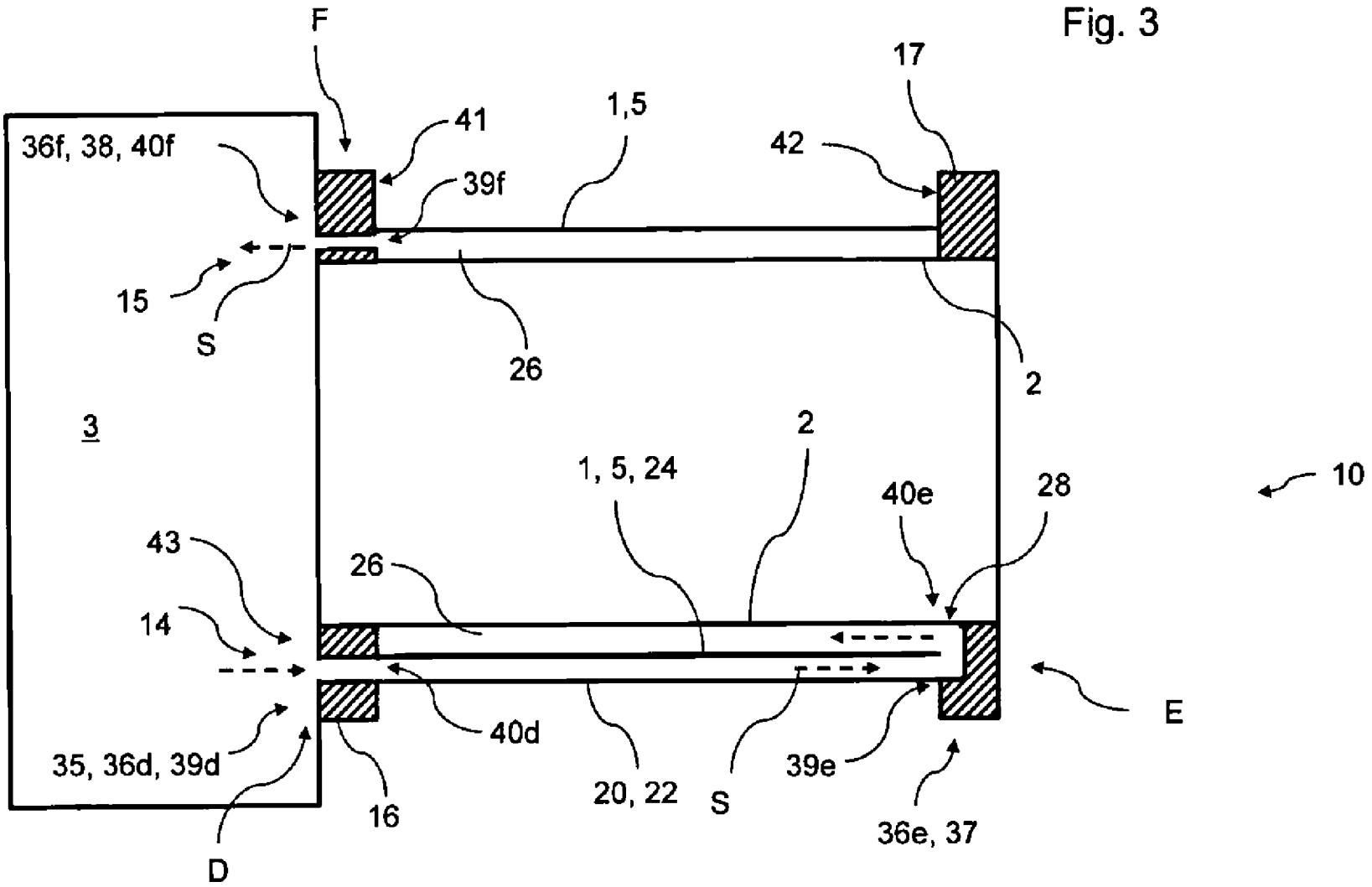
FIG. 3 shows a very simplified diagrammatic view of a longitudinal section of a further embodiment of an agitator ball mill according to the invention.

FIG. 3 represents further embodiments of flange lead-throughs 36*d*, 36*e*, 36*f* on the basis of a diagrammatic longitudinal cross-section section similar to that in FIG. 2. For the sake of simplification, the representation of a mounting flange 4, as is shown in FIG. 2, is dispensed with in FIG. 3.

The flange lead-through according to variant D largely corresponds to variant A known from FIG. 2, but lies closer to casing container 1, i.e. inlet opening 14 of housing-side flange 16 is also closer to casing container 1. This embodiment may be necessary when, as represented in FIG. 3, flange line 20 is constituted as a casing line 22, wherein a part of the outer surface of casing container 1 also forms part of casing line 22, so that casing container 1 and casing line 22 form a common wall 24, at which the fluid is conveyed along from housing-side flange 16 to bottom flange 17.

Variant E of a flange lead-through 36 on bottom flange 17 can be constituted for example as a bore 28 introduced into side wall 42 facing machine housing 3. Since casing container 1 or common wall 24 does not project into bore 28 at the level of side wall 42, the fluid flowing in flow direction S in bore 28 is guided around common wall 24 into cavity 26.

The fluid can finally exit from agitator ball mill 10 through flange lead-through 36*f* referred to as variant F or outlet opening 15. The flange lead-through according to variant F is constituted as a cavity channel 38, wherein first opening 39*f* of flange lead-through 36*f* introduced into side wall 41 facing away from machine housing 3 creates a connection to cavity 26.

It is self-evident that flow direction S described in FIGS. 2 and 3 serves only for clarification and can also run in the opposite direction. It therefore goes without saying that the designations first opening 39 and second opening 40 are primarily of an explanatory nature and are to be understood as being dependent on a flow direction or suchlike and not in absolute terms.

Figure 4:
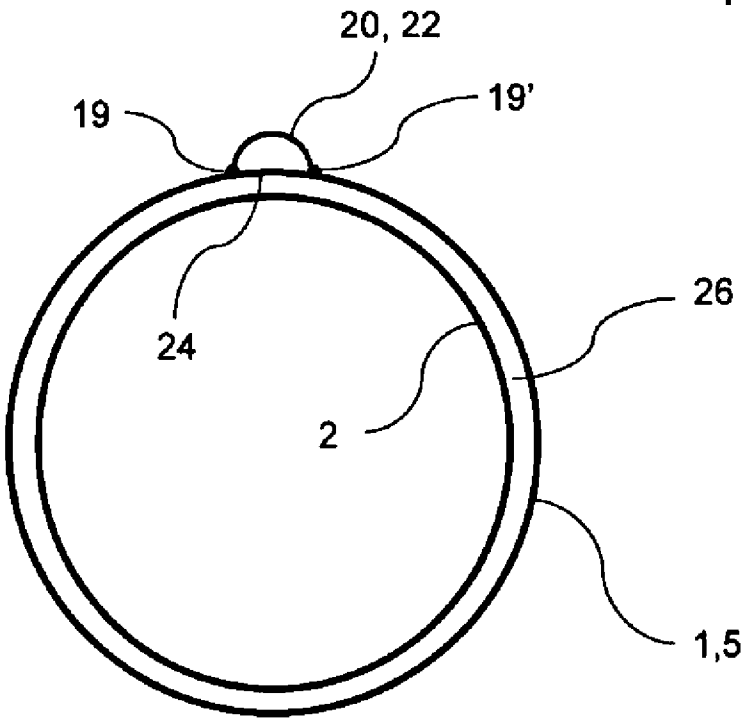
FIG. 4 shows a very simplified diagrammatic view of a cross-section of a grinding container and casing container of the agitator ball mill according to the invention with a casing line disposed thereon.

Finally, FIG. 4 shows a diagrammatic cross-section through the container of an agitator ball mill, which is intended to serve to explain an embodiment of a flange line. Grinding container 2 disposed in casing container 1 is constituted uniformly spaced apart from the latter radially, the two containers 1, 2 thereby enclosing cavity 26. A flange line 20 is fixed on casing container 1, which flange line is constituted as casing line 22 in the representation of FIG. 4. Casing line 22 shown in the example has a roughly semicircular cross-section, is located with the respective ends of the arc of circle on casing container 1 and is fixedly connected to the latter at each side by connections 19 and 19'. Various fixing methods are conceivable for connection 19, for example gluing, soldering or suchlike; a weld joint is however regarded as preferable.

As shown in FIG. 4, the part of casing container 1 located between connections 19 and 19' is at the same time part of casing line 22, thus representing a common wall 24 of casing container 1 and casing line 22. A fluid flowing through casing line 22 thus flows along casing container 1.

In this connection, it should not be overlooked that the shape of casing line 22 does not necessarily have to be semicircular as represented in FIG. 4, but can also have another shape and for example have an elliptical or angular base shape. It is of primary importance in this connection that casing container 1 and casing line 22 have a common wall 24 and casing line 22 is fixed to the casing container by two connections 19, 19', since this type of fixing has a greater stability than for example when welding a flange line 20 constituted as a pipeline, which can be perceived as a connection of two pipes of differing diameter. The casing line according to the one known from FIG. 4 has, in contrast with the latter connection, a much better mechanical stability.

The invention has been described by reference to a preferred embodiment. A person skilled in the art can however imagine that modifications or changes to the invention can be made without thereby departing from the scope of protection of the following claims.

What is claimed is:

1. An agitator ball mill with a fluid circuit comprising, a machine housing, a grinding container, and a casing container having an outer surface disposed around the grinding container in a radial direction, wherein the casing container and the grinding container are disposed coaxial and radially spaced apart such that a cavity is formed between the two containers, wherein the casing container and the grinding container are fixed at a proximal axial end to a housing-side flange lying adjacent to the machine housing or to a mounting flange disposed in the machine housing and at a distal axial end to a bottom flange located remote from the machine housing, wherein at least one of the flanges comprises a flange lead-through configured to guide fluid to or from the cavity, and wherein the flange lead-through comprises a first opening and a second opening, and wherein the first opening of the flange lead-through is disposed on a side wall of the respective flange, the first opening being arranged orthogonal to an axial direction of the cavity, and wherein a flange line, located outside the casing container, connects the housing side flange or the mounting flange to the bottom flange.

2. The agitator ball mill according to claim 1, wherein:

the flange lead-through is a cavity channel, wherein the second opening is disposed at a transition region between the respective flange and the cavity; or the flange lead-through is a flange channel, wherein the second opening is located on the side of the respective flange lying opposite the first opening of the respective flange lead-through.

3. The agitator ball mill according to claim 2, wherein the housing-side flange comprises at least one cavity channel and/or at least one flange channel.

4. The agitator ball mill according to claim 3, wherein the bottom flange comprises at least one cavity channel and/or at least one flange channel.

5. The agitator ball mill according to claim 4, wherein the openings of the flange lead-through constituted as the cavity channel and/or the flange channel in the housing-side flange and the bottom flange are connected to one another by the flange line, said openings being disposed in the respective side wall and in each case facing one another.

6. The agitator ball mill according to claim 5, wherein the flange line is constituted as a closed pipeline.

7. The agitator ball mill according to claim 5, wherein the flange line is a casing line fixed to the outer surface of the casing container, wherein a part of the outer surface of casing container is also part of the casing line.

8. A method for conveying a fluid in an agitator ball mill with a fluid circuit, wherein the agitator ball mill comprises a machine housing, a grinding container and a casing container having an outer surface disposed around the grinding container in a radial direction, wherein the casing container and the grinding container are disposed coaxial and radially spaced apart such that a cavity is formed between the two containers, wherein the casing container and the grinding container are fixed at a proximal end to a housing-side flange lying adjacent to the machine housing or to a mounting flange disposed in the machine housing and at a distal end to a bottom flange located remote from the machine housing, wherein at least one of the flanges comprises a flange lead-through configured to guide fluid to or from the cavity, and wherein the flange lead-through comprises a first opening and a second opening, and wherein the first opening of the flange lead-through is disposed on a side wall of the respective flange, the first opening being arranged orthogonal to the outer surface, and wherein a flange line, located outside the casing container, connects the housing side flange or the mounting flange to the bottom flange; and wherein the fluid flow is conveyed from the flange lead-through into the flange line and to the cavity.

9. The method according to claim 8, wherein a first fluid can be displaced from the fluid circuit by supplying a further fluid different from the first fluid.

10. A method for conveying a fluid in an agitator ball mill comprising:

guiding a fluid into a flange lead-through, the flange lead-through being disposed through a flange connecting a grinding container and a casing container adjacent to or opposite of a machine housing, leading the fluid, via flange line outside the cavity, to a cavity, the cavity being formed by an outer surface of the grinding container and an inner surface of the casing container, such that the grinding container and the casing container are radially spaced apart, wherein the flange lead-through comprises a first opening and a second opening, and wherein the first opening of the flange lead-through is disposed on a side wall of the respective flange, the first opening being arranged orthogonal to an axial direction of the cavity.

11. The method for conveying a fluid in an agitator ball mill of claim 10, wherein the flange line is welded or soldered to the outer surface of the casing container such that the casing container is a bottom surface of the flange line.

12. The agitator ball mill according to claim 7 wherein the casing line is welded or soldered to the casing container.

13. An agitator ball mill with a fluid circuit comprising:

a grinding container;

a machine housing attached to said grinding container at a proximal end via a first flange;

a casing container disposed around the grinding container, such that a cavity is arranged radially between the grinding container and the casing container;

wherein the first flange comprises a first flange lead-through which guides fluid to the machine housing from the cavity or to the cavity from the machine housing;

wherein the fluid flow at an opening of the first flange lead-through is substantially parallel to an axial direction of the cavity.

14. The agitator ball mill of claim 13, further comprising a second flange which connects a distal end of the grinding container and a distal end of the casing container.

15. The agitator ball mill of claim 14, further comprising a flange line disposed along an exterior surface of the casing container, wherein the flange line guides fluid in a direction from the first flange to the second flange; and a second flange lead-though in the second flange providing an opening from the flange line to the cavity.

16. The agitator ball mill of claim 15, wherein the flange line guides said fluid in a direction parallel to a longitudinal axis of the casing container before said fluid passes through said second flange lead-through.

17. The agitator ball mill of claim 13, further comprising a flange line located outside the casing container which guides fluid from the first flange distally to an opening in the casing container to the cavity.

18. The agitator ball mill of claim 13, wherein the first flange comprises a second flange lead-through wherein the first flange lead-through guides fluid to the cavity from the machine housing and the second flange lead-through guides fluid to the machine housing from the cavity.

* * * * *